US006664512B2

(12) United States Patent
Horey et al.

(10) Patent No.: US 6,664,512 B2
(45) Date of Patent: Dec. 16, 2003

(54) WARMING BLANKET WITH HEAT REFLECTIVE STRIPS

(75) Inventors: Leonard I. Horey, Boca Raton, FL (US); Armando Alvite, Miami, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/243,335

(22) Filed: Sep. 10, 2002

(65) Prior Publication Data

US 2003/0047549 A1 Mar. 13, 2003

Related U.S. Application Data

(60) Provisional application No. 60/318,917, filed on Sep. 11, 2001, provisional application No. 60/318,986, filed on Sep. 11, 2001, and provisional application No. 60/318,998, filed on Sep. 11, 2001.

(51) Int. Cl.[7] ..... H05B 1/00

(52) U.S. Cl. ..... 219/212; 219/211; 219/528; 219/529; 219/543; 219/549

(58) Field of Search ..... 219/212, 211, 219/217, 528, 529, 543, 544, 545, 549; 428/196; 392/425, 432, 435

(56) References Cited

U.S. PATENT DOCUMENTS

| | | | | | |
|---|---|---|---|---|---|
| 2,783,358 | A | | 2/1957 | Wolf | |
| 3,417,229 | A | | 12/1968 | Shomphe et al. | |
| 3,766,644 | A | | 10/1973 | Davis | |
| 4,132,262 | A | * | 1/1979 | Wibell | 219/212 |
| 4,186,294 | A | | 1/1980 | Bender | |
| 4,273,989 | A | * | 6/1981 | Hinton et al. | 219/211 |
| 4,354,091 | A | * | 10/1982 | Bain | 219/212 |
| 4,538,054 | A | * | 8/1985 | de la Bretoniere | 219/545 |
| 4,736,088 | A | * | 4/1988 | Bart | 219/211 |
| 4,798,936 | A | | 1/1989 | Johnson, Sr. | |
| 4,922,084 | A | | 5/1990 | Hutter | |
| 4,950,868 | A | * | 8/1990 | Moss et al. | 219/211 |
| 5,371,340 | A | | 12/1994 | Stanfield | |
| 5,410,127 | A | | 4/1995 | LaRue et al. | |
| 5,591,365 | A | | 1/1997 | Shields | |
| 5,708,256 | A | * | 1/1998 | Montagnino et al. | 219/212 |
| 5,837,971 | A | | 11/1998 | Lee | |
| 5,925,441 | A | * | 7/1999 | Blauer et al. | 428/196 |
| 5,932,129 | A | | 8/1999 | Hyatt | |
| 5,986,243 | A | * | 11/1999 | Campf | 219/529 |
| 6,078,026 | A | | 6/2000 | West | |
| 6,229,123 | B1 | | 5/2001 | Kochman | |
| 6,331,695 | B1 | * | 12/2001 | West | 219/212 |
| 6,403,935 | B2 | * | 6/2002 | Kochman et al. | 219/545 |

* cited by examiner

*Primary Examiner*—Sang Y. Paik
*Assistant Examiner*—Fadi H. Dahbour
(74) *Attorney, Agent, or Firm*—Lawrence J. Shurupoff

(57) ABSTRACT

Heat losses from electric heating pads, blankets and pillows are reduced by aligning heat reflective strips or coatings over the top of a heating wire arranged inside the pads, blankets and pillows. By reducing heat losses, lower wattage can be applied to the heating wire to transfer the same amount of heat to a user as equivalent higher wattage blankets which do not have the heat reflective strips. By lowering the applied wattage, a more efficient blanket results.

14 Claims, 3 Drawing Sheets

THERMALLY REFLECTIVE MATERIAL PLACED ON TOP SIDE OF BLANKET ONLY.

THERMALLY REFLECTIVE MATERIAL PLACED ON TOP SIDE OF BLANKET ONLY.

WARMING BLANKET WITH HEAT REFLECTIVE STRIPS

This application claims the benefit of U.S. Provisional Serial No. 60/318,917 filed Sep. 11, 2001, and Provisional Application Serial No. 60/318,986 filed Sep. 11, 2001, and Provisional Application Serial No. 60/318,998 filed Sep. 11, 2001.

FIELD OF THE INVENTION

The present invention relates in general to electric heating blankets, pads, pillows and the like and in particular to such heating products which include internal strips of heat reflective material.

DESCRIPTION OF PRIOR DEVELOPMENTS

Present day warning blankets can draw as much as 180 watts of power during normal operation. Reducing this power is desirable for several reasons. First, reducing the power saves energy and makes the blanket more economical to operate. Second, reducing the wattage offers the possibility of reducing the size of the wire which lowers cost and improves comfort. Third, controlling a reduced wattage blanket allows the control electronics to dissipate less heat thereby allowing for the use of a smaller heat sink. Finally, by using less power, the operating voltage can be reduced to, say, about 33 volts AC which is less complicated to operate and poses fewer safety issues.

Unfortunately, if one just decreases the wattage of a heating blanket, the blanket will not produce sufficient heat for a user. In order to allow the wattage to be decreased and yet provide the same amount of heat to a user, the heat losses from the blanket must also be decreased. Attempting to insulate the blanket to reduce heat losses doesn't solve the problem. By insulating the blanket, the heat losses are reduced, but then it is also more difficult for the heat to flow through the insulation from the wire to the user. Using a heat reflective sheet can help, but such sheets are bulky and prevent the blanket from breathing, i.e., from allowing water vapor to flow outwardly from a user's body through the blanket.

What is required is some way to prevent heat losses without impeding the flow of heat from the wires to the user and without significantly affecting the passage of moisture or breatheability of the blanket. The solution, according to this invention, is to place strips of thermally reflective material on the top side of the blanket and aligned over the heating wires. In this manner substantially all of the available heat is directed downward towards the user, thereby increasing the amount of heat delivered to the user for a given input wattage, or allowing for the use of a lower wattage input with equivalent heating.

SUMMARY OF THE INVENTION

The present invention has been developed to fulfill the needs noted above and therefore has as an object the provision of a heating blanket, pad, pillow or the like which provides (transfers) equivalent heat to a user as that provided by similar conventional heating products, yet which requires significantly less electrical power to achieve such equivalent warming.

This result is achieved by providing a heat reflective layer of material in the form of thin heat reflecting strips or bands on only one side of the heating elements, which are typically resistance wires. The reflective layer can be provided as thin strips of heat reflective metal or plastic foil sewn or bonded onto the blanket or onto a substrate within the blanket. Aluminized coatings can also be used as well as titanium compounds such as found on ironing board covers. The thin strips are aligned directly over the top surface of the resistance wires to reflect heat downwardly to a user.

The strips can also be applied as a spray or liquid coating to the blanket or to an internal substrate within the blanket. The spray can be applied by a moving nozzle in the manner of applying spray paint or applied over a stencil with a spray nozzle, brush or roller.

Another approach is to apply a reflective coating directly to a portion, i.e., the upper half, of the resistance wire. The reflective coating or strips can also be applied as heat reflective adhesive tape. In each of the noted variations, substantially all of the heat produced by the resistance wire is transferred to a user, thereby increasing the amount of heat transferred to the user for a given input wattage to the heating wires or heating elements.

By limiting the heat reflective material to thin bands, thin coatings or thin patches or strips located directly above the heating element (wires), most of the blanket remains "breathable," i.e., capable of passing moisture, i.e., water vapor, outwardly to the ambient from a user. This greatly improves the comfort of the user and allows the blanket to remain lightweight, pliable and compliant.

In order to construct the reduced wattage blanket, heating wire is first laid out on a thin pliable substrate. Then strips of the thermally reflective material are placed over the wires. The reflective material is then attached to the substrate, and can also secure the wire to the substrate. Finally, the complete substrate is placed inside a blanket shell. It is also possible to eliminate the substrate and apply the wire directly to an interior surface of the upper half of the shell, preferably before the two halves of the shell are completely sewn together.

DETAILED DESCRIPTION OF THE PREFERRED EMBODIMENTS

Figure 1:
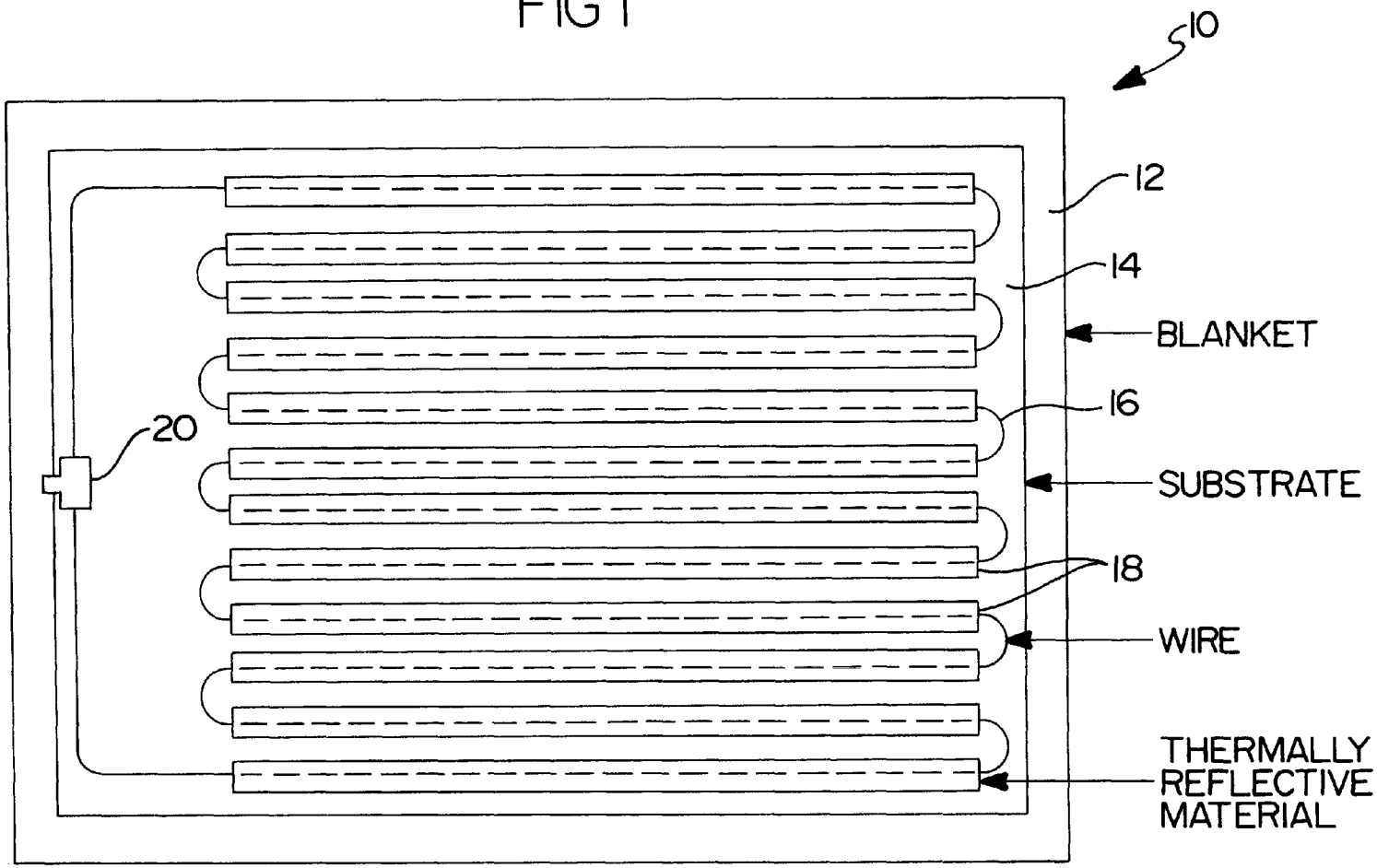
FIG. 1 is a schematic top plan view of a blanket constructed in accordance with the invention, with the top layer of the blanket cover or shell removed for clarity.

The present invention will now be described in conjunction with the drawings, beginning with FIG. 1 which shows a heating blanket assembly 10 constructed in accordance with the invention. Although the invention is described using a blanket as an example, the invention is equally applicable to heating pads, pillows and wraps.

The assembly 10 includes a blanket or outer cover 12, typically formed of a pliable fabric material known and referred to as a "shell". The blanket cover or shell 12 is generally formed as a two-layered laminate which forms a pocket which receives and encloses a substrate 14, heating element 16 and reflective strips 18. An electrical connector 20 is provided on the substrate 14 in a known manner to connect the heating element 16 to a source of electrical power.

Only the bottom half layer of the outer cover or shell 12 is shown in FIG. 1. Substrate 14 is formed of a thin sheet of breathable material such as a non-woven natural or synthetic material such as a non-woven polyester fabric. This material preferably has a light, breathable gauze-like consistency. A perforated breathable plastic or elastomeric sheet of material may also be used for substrate 14. The substrate is needed only for facilitating manufacture, and may be omitted.

The heating element 16 in FIG. 1 is shown arranged in a closed serpentine loop on top of the substrate 14, with each end connected to the electrical connector 20. The heating element 16 may be attached directly to substrate 14 by adhesive bonding, stitching, ultrasonic welding, or other mechanical or chemical means.

Alternatively, the heating element 16 may be held on substrate 14 by the heat reflective strips 18. In this case, the heat reflective strips can have an adhesive underside which can be applied over the heating element 16 in the manner of a strip of adhesive tape and thereby tape and hold the heating element against the substrate.

Another alternative is to sew the strips 18 over the heating element 16 and to the substrate 14 so as to capture the heating element between the strips and substrate. Gluing, ultrasonic welding and direct spray painting can also be used to hold the resistance wire in place. The heat reflective strips can be applied to the wires and substrate as strips of heat reflective metal foil, metallized plastic or fabric, adhesive tape, or as a thin coating such as heat reflective paint.

Figure 3:
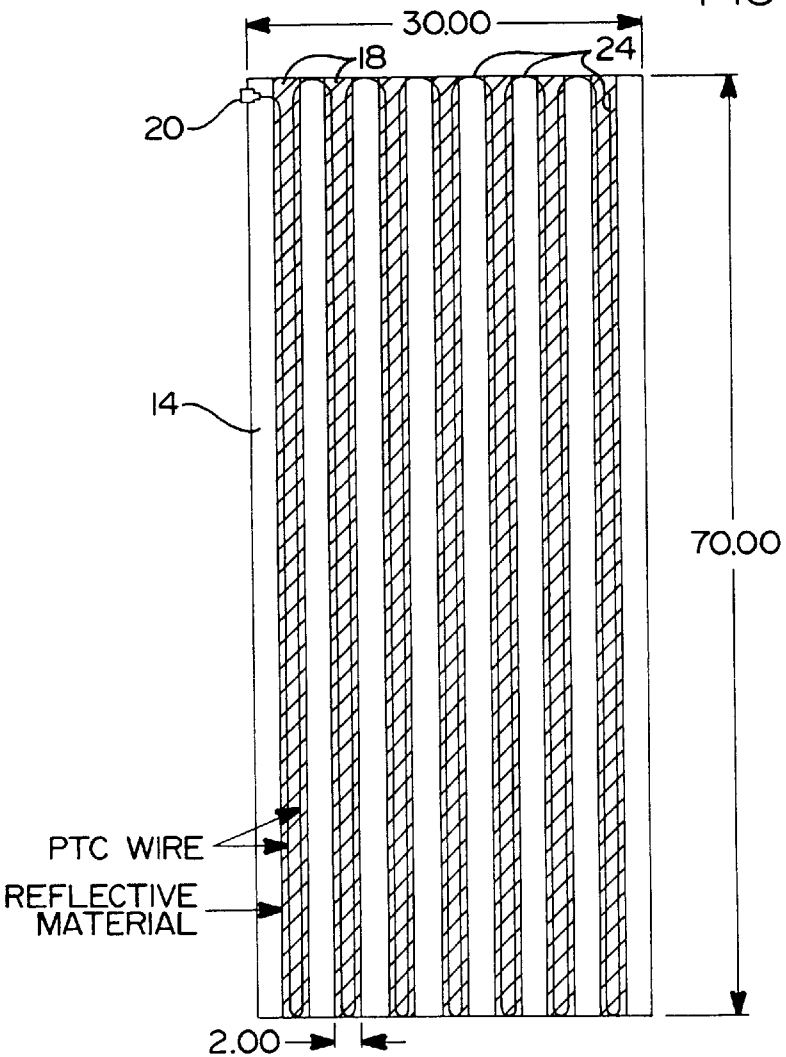
FIG. 3 is a schematic top plan view of the blanket substrate of FIG. 2 having a pattern of reflective strips provided thereon in accordance with the invention.
Figure 2:
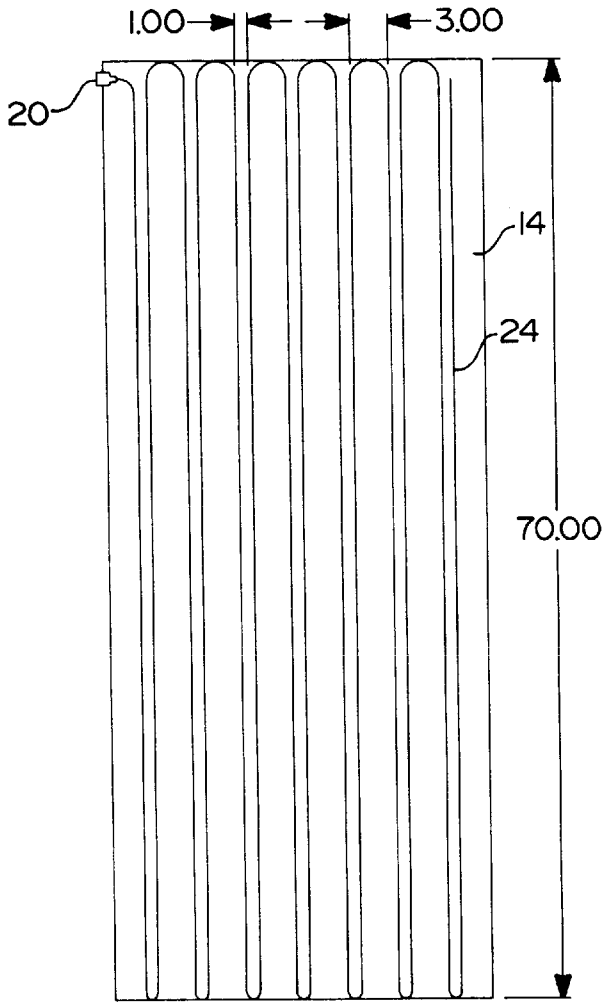
FIG. 2 is a schematic top plan view of a blanket substrate having PTC wire provided thereon in accordance with the invention.

As seen in FIGS. 2 and 3, the present invention is particularly well adapted for use with heating elements formed of positive temperature coefficient (PTC) heating wire 24. In this example, the wire 24 is first applied to a substrate 14 in a serpentine pattern. An electrical connector 20 is secured to the edge of the substrate and connected to one end of the wire 24. The other end of the wire is free and if a current sensor is used externally of the substrate, the wire need not loop back to the connector 20 when PTC wire is used. The current sensor provides a signal to a safety circuit which terminates power to the heating wire in the event an electrical fault is detected.

The substrate 14 shown in FIG. 2 is provided with longitudinally-extending strips 18 of heat-reflective material as shown in FIG. 3. The strips 18 are spaced apart so as to overlie a pair of adjacent longitudinally-extending wires when the strips are superimposed over the wires and subsequently connected to the substrate. The resulting semi-laminated substrate is then placed within a blanket cover 12. The spaces between the reflective strips define moisture escape passages to allow moisture to escape to the ambient and allow the blanket assembly 10 to breathe.

Figure 4:
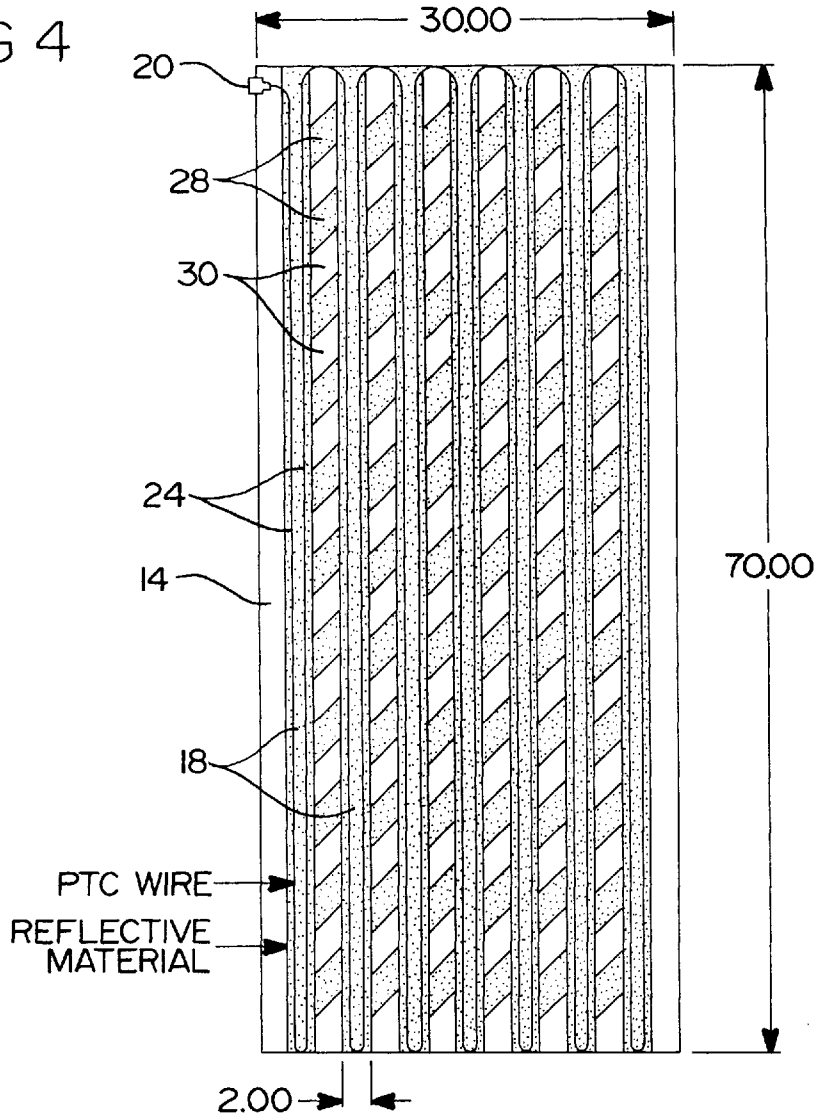
FIG. 4 is a view similar to FIG. 3 showing an alternate pattern of reflective strips.

If additional heat insulation is desired, additional heat reflective transverse strips or portions 28 shown in FIG. 4 may be provided between the longitudinally-extending strips 18. In this embodiment, parallelogram or diamond-shaped openings 30 are defined between the longitudinally-extending strips 18 and the transverse strip portions 28 to allow for the passage of moisture and water vapor through the assembly 10, while maintaining a pliable breathable blanket construction.

It should be noted that it is possible to apply the heat reflective strips directly to the inside surface of one side of the blanket cover 12 and avoid the use of one or two substrate sheets. The wire can be attached to the blanket cover 12 in a manner similar to that described above regarding the connection of the wire to the substrate 14.

Figure 5:
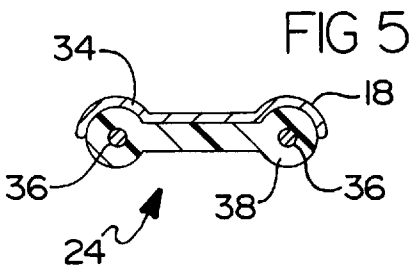
FIG. 5 is an enlarged radial sectional view through a PTC heating wire constructed in accordance with another embodiment of the invention.

It is also possible to apply heat reflective material 34 as a coating or film or tape applied directly to one side or half of the heating wire 16, as shown in FIG. 5. In this case, conventional blanket manufacturing techniques and constructions are enabled without any special consideration for the use of the reflective material 34, other than the option to provide much lower wattage to the blanket assembly 10 than with prior blanket assemblies.

The wire 24 shown in FIG. 5 is a PTC wire having a pair of parallel current carrying wires 36 embedded in a dog bone or dumbbell-shaped matrix of carbon-particle containing plastic material 38. Current flows from one wire 36 to the other through the plastic material 38. In this manner, heat is generated along the entire length of the wire. The heat reflective material 34 reduces the amount of heat escaping upwardly away from a user by reflecting heat toward the user that would otherwise be lost to the ambient.

An advantage of the present invention is the ability to manufacture and inventory a large quantity of substrate subassemblies having heating element 16 or heating wire 24 mounted thereon along with reflective strips 18. These subassemblies can be later inserted into various colors and sizes and fabrics of blanket shells 12 as market needs demand. This eliminates the need to stockpile and inventory the entire blanket assembly 10. The shells 12 can be fabricated on demand as needed, and the subassemblies can be taken from inventory and quickly be assembled into a complete assembly 10.

What is claimed is:

1. A heating assembly comprising:

a pliable cover;

a heating element provided in said cover; and at least one heat reflective member provided over said heating element and extending over a limited portion of said cover so as to define at least one moisture passage around said heat reflective member and through said assembly.

2. The assembly of claim 1, wherein said pliable cover comprises a fabric blanket shell.

3. The assembly of claim 1, further comprising a substrate provided within said cover, and wherein said heating element is carried by said substrate.

4. The assembly of claim 3, wherein said substrate comprises a non-woven porous material.

5. The assembly of claim 3, wherein said heating element is held on said substrate by said heat reflective member.

6. The assembly of claim 3, wherein said heating element comprises PTC wire.

7. The assembly of claim 1, wherein said at least one heat reflective member comprises a plurality of heat reflective strips.

8. The assembly of claim 7, wherein said heat reflective member is selected from the group consisting of heat reflective tape, heat reflective fabric, metallized plastic, metallized fabric, metal foil, heat reflective paint, and heat reflective coatings.

9. The assembly of claim 7, wherein said strips are arranged in parallel with one another.

10. The assembly of claim 1, wherein said heating element comprises a PTC wire arranged in a serpentine pattern and wherein said at least one heat reflective member com prises a plurality of individual spaced-apart heat reflective strips overlying adjacent portions of said PTC wire.

11. The assembly of claim 1, wherein said heating element comprises a PTC wire having a first end connected to an electrical connector and a second free end spaced apart from said electrical connector.

12. The assembly of claim 1 wherein said heat reflective member is disposed directly upon said heating element.

13. A method of assembling a heating assembly, comprising:

providing a subassembly comprising a compliant substrate and a heating element carried thereon;

providing a fabric shell for receiving said subassembly;

inserting said subassembly into said shell; and providing at least one heat reflective member over said heating element and extending across a limited portion of said heating assembly so as to define at least one moisture passage around said heat reflective member and through said heating assembly.

14. The method of claim 13 wherein said heat reflective member is a heat reflective strip and further comprising the step of attaching said heat reflective strip over said heating element prior to said inserting.

* * * * *